US009109425B2

(12) United States Patent
King et al.

(10) Patent No.: US 9,109,425 B2
(45) Date of Patent: Aug. 18, 2015

(54) REMOVABLE FRACTURING PLUG OF PARTICULATE MATERIAL HOUSED IN A SHEATH SET BY RELATIVE END MOVEMENT OF THE SHEATH

(75) Inventors: James G. King, Kingwood, TX (US); Edward J. O'Malley, Houston, TX (US); Charles C. Johnson, League City, TX (US); James C. Doane, Friendswood, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 310 days.

(21) Appl. No.: 13/588,854

(22) Filed: Aug. 17, 2012

(65) Prior Publication Data

US 2014/0048252 A1 Feb. 20, 2014

(51) Int. Cl.
*E21B 33/128* (2006.01)
*E21B 33/12* (2006.01)

(52) U.S. Cl.
CPC ..... *E21B 33/1208* (2013.01); *E21B 33/128* (2013.01)

(58) Field of Classification Search
CPC ... E21B 2033/005; E21B 33/00; E21B 33/10; E21B 33/12; E21B 33/128
USPC ..... 166/179, 135, 192
See application file for complete search history.

(56) References Cited

U.S. PATENT DOCUMENTS

| | | | | |
|---|---|---|---|---|
| 2,781,852 | A * | 2/1957 | Rumble | 166/120 |
| 5,417,285 | A | 5/1995 | Van Buskirk et al. | |
| 5,623,993 | A | 4/1997 | Van Buskirk et al. | |
| 7,422,071 | B2 | 9/2008 | Wilkie et al. | |
| 7,673,692 | B2 | 3/2010 | Kunz et al. | |
| 7,690,427 | B2 | 4/2010 | Rispler | |
| 7,997,337 | B2 | 8/2011 | Kunz | |
| 8,151,895 | B1 | 4/2012 | Kunz | |
| 2002/0056553 | A1 * | 5/2002 | Duhon et al. | 166/302 |
| 2006/0272806 | A1 * | 12/2006 | Wilkie et al. | 166/192 |
| 2010/0018694 | A1 * | 1/2010 | Kunz | 166/179 |
| 2010/0276159 | A1 * | 11/2010 | Mailand et al. | 166/382 |
| 2011/0136707 | A1 * | 6/2011 | Xu et al. | 507/270 |
| 2012/0012303 | A1 * | 1/2012 | Xu | 166/88.2 |

* cited by examiner

*Primary Examiner* — Brad Harcourt
(74) *Attorney, Agent, or Firm* — Steve Rosenblatt

(57) ABSTRACT

The removable plug features a solid material that is housed in a porous container that has its shape changed to transition from the run in shape to the set shape. A running string and setting tool that creates relative movement deliver the plug and pull on its lower end while holding the top stationary against a backing plate. The container is pulled into itself as the radial dimension grows for the set. There can be a mandrel that remains in position and can lock to the backing plate or alternatively there can be no mandrel or a removable mandrel. The porous container can be removed in a variety of ways to let the solid material escape to be removed with fluid circulating in the wellbore. Alternatively the mandrel can be undermined to let the solid material escape for recovery.

21 Claims, 4 Drawing Sheets

REMOVABLE FRACTURING PLUG OF PARTICULATE MATERIAL HOUSED IN A SHEATH SET BY RELATIVE END MOVEMENT OF THE SHEATH

FIELD OF THE INVENTION

The field of the invention is removable plugs and more particularly plugs filled with a solid material that is contained in a porous member that has its shape changed to set the plug and the plug structure subsequently altered for release of the plug.

BACKGROUND OF THE INVENTION

Zones in a wellbore have been isolated from each other with sand plugs. Typically, a porous substrate is supported in the wellbore and sand is pumped onto the substrate. Pressure is applied and the sand is dewatered. If a long enough sand column is created, the pressure applied from pumped fluid above forces the sand particles together in such a manner as to create a barrier to isolate zones in a wellbore from each other. When the barrier is no longer needed a jetting tool at the end of coiled tubing or the like is run into position above the plug. The jetting action and the circulation starts to work on the compacted sand pile and eventually allows the particles to come off the cohesive plug and get lifted from the well with the circulating fluid that exits the jetting nozzles. Some examples of this technique are U.S. Pat. Nos. 5,623,993 and 5,417,285. Other efforts in horizontal wells involve recipes of a variety of granular components that have predetermined properties such as specific gravity below 1.25 to create the plug using deposition techniques. One example of this is U.S. Pat. No. 7,690,427.

Other designs place swelling material in porous enclosures and allow the swelling action to create relative movement that allows a packer to go from a run in to a set position as overlapping petals of swelling material in enclosures rotate relatively to reach a sealing configuration in a borehole. This technique is illustrated in U.S. Pat. No. 7,422,071.

What is needed and provided by the present invention is a plug that can be set with a setting tool that creates relative movement and features a solid granular material in a porous enclosure where the setting action alters the shape of the enclosure to attain the set position. This can be done by bringing one end closer to another end and preferably through a passage in an annularly shaped sheath. Alternatively a swage can be brought through a passage in an annularly shaped sheath to enlarge the passage and in so doing set up the fill material in the sheath to push against the surrounding wellbore while a valve such as a flapper closes the passage to pressure from above. The porous enclosure can then be undermined in a variety of ways to allow the granular material to escape where it can be removed with fluid circulation. In some variations, a mandrel allows flow therethrough until an object is landed on a seat for zonal isolation. In other instances the mandrel can be undermined as a way of letting the granular material escape. The retaining porous material can be dissolved or in other ways removed so that it will not interfere with the working of other tools in the borehole. For fracturing plug purposes, perfect sealing is not required as long as sufficient flow past the plug is sufficiently slowed so that the acting pressure can deliver the requisite flow into the fractures to further open them, in the known manner. The use of a mandrel can also be optional and the plug structure can comprise a granular material in a porous enclosure that folds on itself to set. An optional lock feature or a valve to prevent reverse flow in the setting location when relative movement occurs can also be incorporated. These and other features can be incorporated into the design as will be more readily apparent to those skilled in the art from review of the details of the description of the preferred embodiment and the associated drawings, while understanding that the full scope of the invention is to be determined from the appended claims.

SUMMARY OF THE INVENTION

The removable plug features a solid material that is housed in a porous container that has its shape changed to transition from the run in shape to the set shape. A running string and setting tool that creates relative movement deliver the plug and pull on its lower end while holding the top stationary against a backing plate. The container is pulled into itself as the radial dimension grows for the set. There can be a mandrel that remains in position and can lock to the backing plate or alternatively there can be no mandrel or a removable mandrel. In an alternative embodiment a setting tool pulls a swage through a passage in an annularly shaped sheath to set up the granular material in the sheath to seal against the borehole wall while the enlarged passage is closed off with a valve such as a flapper after the swage exits the passage. The porous container can be removed in a variety of ways to let the solid material escape to be removed with fluid circulating in the wellbore. Alternatively the mandrel can be undermined to let the solid material escape for recovery.

DETAILED DESCRIPTION OF THE PREFERRED EMBODIMENT

Figure 1:
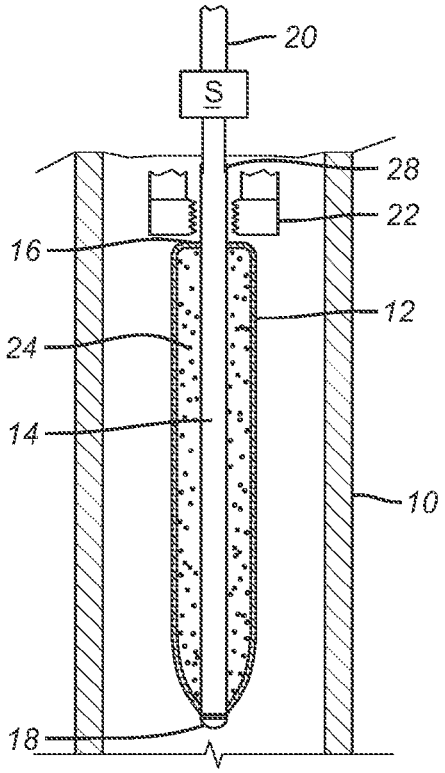
FIG. 1 is a view for run in of one embodiment of the removable plug.
Figure 2:
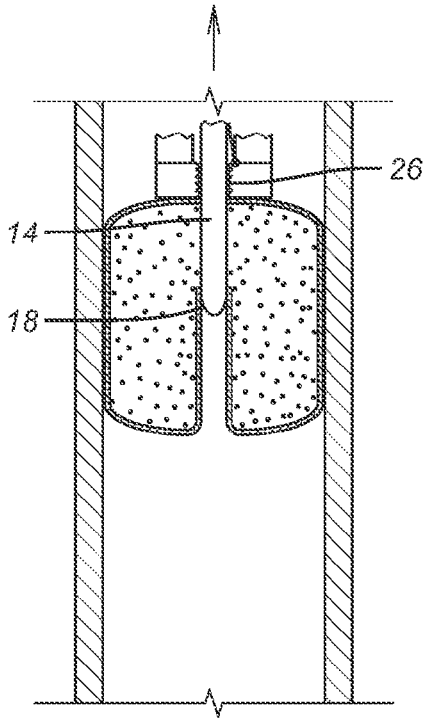
FIG. 2 is the view if FIG. 1 in the setting process as the mandrel is raised internally of the plug.
Figure 3:
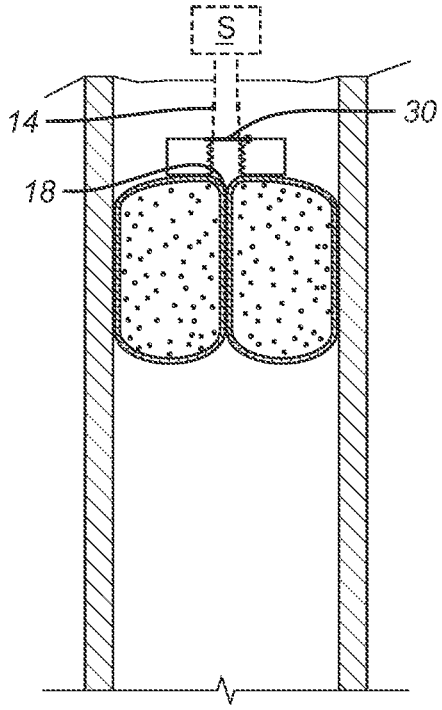
FIG. 3 is the view of FIG. 2 with the plug in the set position and the mandrel removed.

Referring to FIG. 1 the wellbore 10 can be cased or open hole. An elongated porous sheath 12 can be made of a variety of materials that have the requisite strength to contain the loose solid material 14 contained inside as the shape of the sheath 12 is changed. The sheath 12 can be a mesh material using high strength fibers such as Kevlar® or it can also be made of textile materials that are more readily undermined when it is time to release the plug while at the same time minimizing the presence of large pieces of the sheath 12. One possible such sheath material would be nylon. Another is controlled electrolytic material that degrades under certain well conditions to release the fill material 24 when a plug release is needed. The sheath 12 has an initial annular shape with a mandrel 14 extending through the sheath 12 from a top 16 to a bottom 18. The connection at 18 between the sheath 12 and the mandrel 14 is designed to release on application of a predetermined force. A running string or wireline or some other conveyance 20 has a setting tool S that creates relative movement between the backup 22 and the mandrel 14. Such tools are well known in the art and one such tool is the E-4 Wireline Setting Tool sold by Baker Hughes Incorporated. The fill material 24 can be sand, coated proppant, controlled electrolytic material rubber chips or some other solid granular material that will be retained by the sheath 12 as the setting tool S it actuated as shown in FIG. 2. For release the controlled electrolytic material can degrade with well conditions to allow the sheath 12 to go slack so that the plug can be removed. FIG. 2 illustrates the lower end 18 being brought up with the mandrel 14 so that the overall length is shortened as the diameter is increased and the reconfigured shape brings the sheath 12 with the fill material 24 now compressed so that fluid is displaced from its void spaces and those spaces close up. This results in the mass of the fill material 24 in the sheath 12 becoming more and more or completely impervious to through fluid flow. With the radial pressure exerted against the borehole 10 there is now in the FIG. 2 position some or total zonal isolation. As an option the set position can be FIG. 2 with the mandrel 14 remaining in the position shown and a ratchet locking system 26 that allows the mandrel 14 to be pulled up but will prevent reverse direction motion can be used. When doing so the setting tool S can have a breakaway connection 28 to allow its removal after the setting is complete. As a different option, the mandrel 14 can be pulled free of the lower end 18 of the sheath 12 without damage to the sheath 12. The release from the sheath 12 can be based on movement of a predetermined distance or the application of a predetermined force. The mandrel 14 is shown in dashed lines in FIG. 3 after a release from the lower end 18 and after having been raised clear of the backup 22 which allows the flapper 30 that can be spring biased for example with a coiled spring around a pivot shaft akin to subsurface safety valves to the closed position shown in FIG. 3. The closing of the flapper or other type of closure 30 prevents pressure above the set plug from pushing end 18 back to its original position and undermining the set position. As seen in FIG. 3 the space formerly occupied by the mandrel 14 is closed by the sheath changing shape so that radial sealing force can be exerted against the surrounding borehole 10. It should be noted that particularly in fracturing application that complete sealing is not required. Rather sufficient isolation to allow the required volume at the required pressure to reach the perforations to initiate fractures, enlarge them and deliver proppant to keep them open for subsequent production works sufficiently well. As noted in the embodiment of FIGS. 1-3 the act of setting the plug gets the desired isolation. While a hollow mandrel 14 can be used to allow initial flow through such as during running in, removal of the mandrel puts the plug in functional operating position as a barrier.

There are alternatives available for plug removal from the FIG. 2 set position or the FIG. 3 set position. The mandrel can be made from a material that will degrade in the presence of well fluids or other fluids added to the well. The mandrel 14 can be made from a controlled electrolytic material. Controlled electrolytic materials have been described in US Publication 2011/0136707 and related applications filed the same day. These materials degrade to undermine the seal and can be attached to the sheath 12 in such a manner that the degradation will also cause a failure in the sheath 12 and release of the material 24 that can be removed with circulation or reverse circulation. Alternatively a jet tool can be lowered to reach the sheath and undermine it to allow the material 24 to escape. Another way is to undermine the sheath such as by chemical reaction or melting it so that the sheath remnants and the material 24 can be moved out to the surface with flowing fluids.

Figure 4:
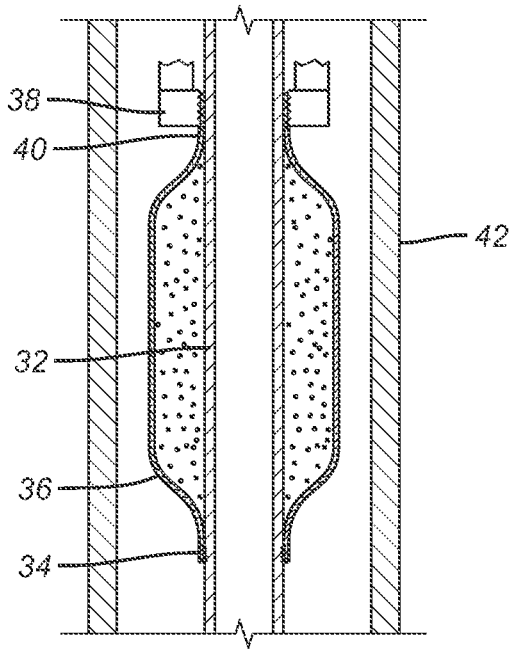
FIG. 4 is an alternative embodiment of the plug shown in the run in position.
Figure 5:
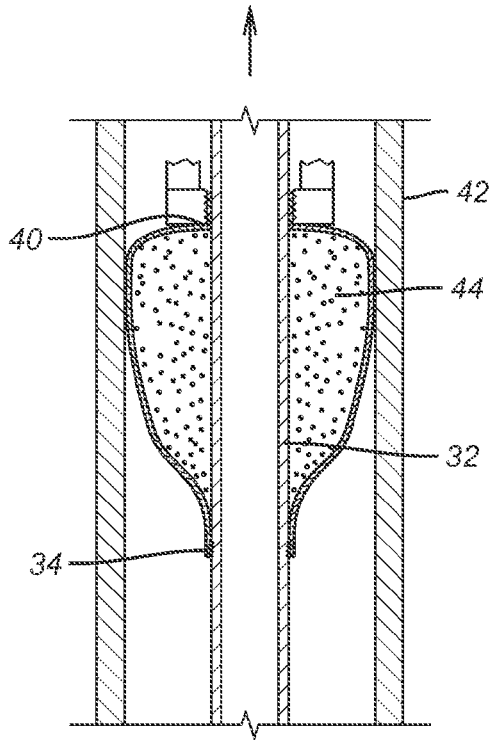
FIG. 5 is the view of FIG. 4 during the setting process.
Figure 6:
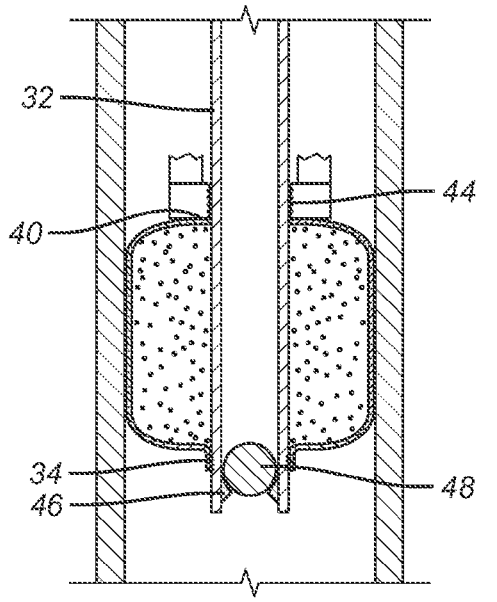
FIG. 6 is the view of FIG. 5 with the plug in the set position and the mandrel left in place.

FIGS. 4-6 are an alternative embodiment that has a hollow mandrel 32 connected to lower end 34 of sheath 36 that has fill material 38 inside. Mandrel 32 is pulled through the backup 38 by a setting tool as previously described for the FIGS. 1-3 embodiments. The upper end 40 of the sheath 36 is held firm against the backup 38 as the lower end 34 is brought closer to the upper end 40. The length of the sheath 36 is reduced as its diameter is increased. Eventually contact with the borehole 42 is made. Borehole 42 can be a tubular or it can be open hole. FIG. 5 shows the onset of the setting process with the lower end 34 coming closer to the upper end 42 that is held stationary by the setting tool S. As before the particulate material 44 is rearranged by the raising of the mandrel 32 as liquids are forced out of the spaces in the material 44 and through the sheath 36 that is preferably a permeable mesh. FIG. 6 shows the fully set position. The mandrel 32 can have a seat 46 on which an object 48 can be landed for sealing contact so that that the plug will function as a frac plug by isolating adjacent zones even if some seepage flow still occurs. The compaction of the material 44 due to raising the mandrel 32 while holding the backup 38 fixed, reforms loose granular material into a more cohesive whole making it impervious or nearly impervious to flow under differential pressure. FIG. 6 illustrates a ratchet locking device that allows the mandrel 32 to be raised when bringing end 34 closer to end 40 while preventing movement in the opposite direction to hold the set position of FIG. 6 against differential pressure from above. Of course, in this embodiment as in the previous embodiment differential pressure from below will merely urge further compression of the material 44 and potentially further bring location 34 closer to location 40 with the lock 50 holding the new position.

Those skilled in the art will appreciate that one or more plugs can be commonly mounted and actuated on a common mandrel. While textiles in mesh form are preferred for the sheath other flexible and porous materials are also envisioned while preference is given to materials that can be more easily undermined for the release of the set plug. Alternatively the mandrel can be undermined to remove the compressive stress from the plug in a set position and to optionally also undermine the sheath at the location of attachment to the mandrel. The sheath or mandrel can respond to well conditions that occur naturally for the release or well conditions can be altered deliberately for the release feature. Another way to release is to simply lower a jet tool and size the backup such that some of the jet streams can go around the backup and impact the sheath to cause openings to form in the sheath and thus to start the release process.

In essence, an annular sheath contains the solid material that will serve as the barrier and is turned inside out in the setting process that brings a lower end up through a central opening in the sheath shape and toward an upper end that is held fixed by the setting tool. The use of the sheath minimizes the amount of material needed to form a reliable barrier as compared to prior techniques of simply pumping sand onto a porous barrier. While one type of filler material can be used, blends of differing materials are also envisioned.

Figure 7:
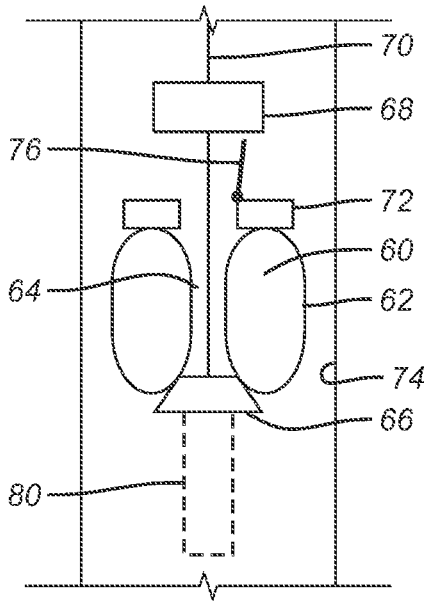
FIG. 7 is an alternative embodiment schematically illustrated in the run in position.
Figure 8:
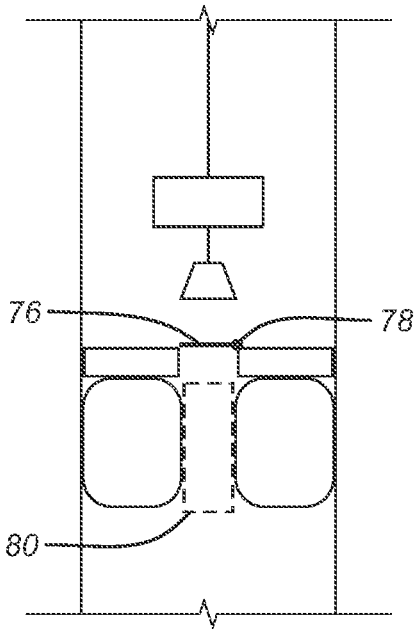
FIG. 8 is the view of FIG. 7 showing the swage advanced through the passage in the sheath and the passage closed with a flapper to differential pressure from above.

FIGS. 7 and 8 represent an alternative embodiment where the solid material 60 is inside a sheath 62 as before. A passage 64 goes through the sheath 62 to define the annular shape for the sheath. A swage 66 is shown at the lower end of the passage 64 and is connected to a setting tool 68 suspended by a string such as wireline, coiled tubing or other elongated conveyance. Support 72 is retained by the setting tool 68 while the swage 66 is drawn into the passage 64. As a result the size of the passage 64 increases as the overall dimension of the sheath increases until contact is made with the borehole 74 which can be a tubular or an open hole at the setting location. The increase in dimension of the passage 64 and the contact of the sheath 62 to the borehole 74 compacts the material 60 pushing out fluid and packing the solid material into a cohesive whole that becomes impervious to fluid. The setting tool 68 moves the swage clear of the passage to allow a valve such as a flapper 76 to either fall to the closed position by its own weight or through the use of a biasing member acting on the flapper 76 or its pivot pin 78. Optionally the force of the biasing can be retained by a latch that is released by the passing swage 66. FIG. 8 shows the flapper 76 in the closed position so that differential pressure from above can be sufficiently retained to perform an operation above the plug in the FIG. set position. The plug need not be leak free and the operation above the plug can be fracturing.

As an alternative to the flapper 76, a mandrel such as 80 that can be positioned with movement of the swage 66 or in the alternative can be expanded by the swage 66 if it is initially in position in the passage 64 can have a seat as described with the previous embodiment so that an object can be dropped on such seat to seal off the passage 64 in this alternative manner. Leaving the passage 64 open after setting the plug allows easy removal of an associated perforating gun that is initially delivered with the plug and the delivery by pumping of a replacement gun through the passage 64 that is still open because an object has yet to be dropped onto the seat in the mandrel. It should be noted that if the mandrel is initially in position in the passage 64 then the swage 66 would start expanding from a location past the seat to avoid damage to the seat and allow the seat to maintain its initial size.

The swage 66 can be fixed or variable and the swage direction can also be in the downhole direction as opposed to the uphole direction shown in FIGS. 7 and 8. If swaging in the downhole direction, the swage 66 can either be dropped in the hole after expansion or simply passed back through the enlarged passage 64 that its original movement has just created.

While relative movement described in the embodiments of FIGS. 1-6 has been to bring ends such as 34 and 40 together, relative movement in the opposite direction is also contemplated to accomplish the setting. Additionally, when the setting occurs by bringing ends together the release can also be accomplished by forcing the ends apart while forcibly overcoming any latching device designed to hold the set position. For example a tool can find support against the plate 38 while pushing the mandrel 32 and overcoming the ratchet 50.

Optionally a releasable mandrel 80 can be releasably attached to the swage 66 to be deposited in the expanded passage 64 after the swage 66 passes. The mandrel 80 can be solid or it can have a passage threrthrough that is later closed by the flapper 76.

The above description is illustrative of the preferred embodiment and many modifications may be made by those skilled in the art without departing from the invention whose scope is to be determined from the literal and equivalent scope of the claims below:

We claim:

1. A plug for subterranean use between zones where flow between said zones is to be minimized, comprising:

an annularly shaped porous sheath having an upper and a lower end when run in and having a fill material therein and defining a passage therethrough, said passage extending between said ends and a mandrel extending in said passage;

said sheath having a run in configuration when said upper and lower ends are spaced apart from each other at a predetermined distance and a set position when said lower end at run in is moved into said passage to define a new lower end for said sheath that is closer to said upper end, wherein fluid is pushed out of said sheath during movement from said run in to said set position.

2. The plug of claim 1, wherein:

said ends are brought toward each other through said passage.

3. The plug of claim 2, wherein:

one of said ends is attached to the mandrel.

4. The plug of claim 3, wherein:

the other of said ends is supported by a stationary backup.

5. The plug of claim 4, wherein:

relative movement between said mandrel and said backup in a first direction brings said ends toward each other while relative movement in a second direction opposite said first direction is prevented.

6. The plug of claim 5, wherein:

a ratchet lock prevents said relative movement in said second direction.

7. The plug of claim 2, wherein:

said sheath comprises a mesh.

8. The plug of claim 2, wherein:

said sheath degrades with exposure to subterranean conditions or to changed conditions at the subterranean location from a remote location.

9. The plug of claim 2, wherein:

said sheath is made of Kevlar, nylon, a controlled electrolytic material or a woven textile material.

10. A plug for subterranean use between zones where flow between said zones is to be minimized, comprising:

an annularly shaped porous sheath having an upper and a lower end when run in and having a fill material therein and defining a passage therethrough, said passage extending between said ends and a mandrel extending in said passage;

said sheath having a run in configuration when said upper and lower ends are spaced apart from each other at a predetermined distance and a set position when said lower end at run in is moved into said passage to define a new lower end for said sheath that is closer to said upper end;

said ends are brought toward each other through said passage;

one of said ends is attached to the mandrel;

said mandrel has a passage therethrough further comprising a seat;

said passage in said mandrel is selectively obstructed by an object landing on said seat.

11. A plug for subterranean use between zones where flow between said zones is to be minimized, comprising:

an annularly shaped porous sheath having a fill material therein and defining a passage therethrough, said passage having a first and second end;

said sheath having a run in configuration when said first and second ends are spaced apart from each other and a set position when said first and second ends are moved relatively with respect to said passage;

said ends are brought toward each other through said passage;

one of said ends is attached to a mandrel;

said mandrel selectively detaches from said end of said sheath in response to a predetermined force bringing said ends toward each other or mandrel movement of a predetermined distance.

12. The plug of claim 11, wherein:

removal of said mandrel from said passage, which closes one of said ends of said passage as said ends are brought together with said mandrel still in said sheath, allows a valve member on said sheath to close a still open end of said passage after said mandrel clears said sheath.

13. A plug for subterranean use between zones where flow between said zones is to be minimized, comprising:

an annularly shaped porous sheath having an upper and a lower end when run in and having a fill material therein and defining a passage therethrough, said passage extending between said ends and a mandrel extending in said passage;

said sheath having a run in configuration when said upper and lower ends are spaced apart from each other at a predetermined distance and a set position when said lower end at run in is moved into said passage to define a new lower end for said sheath that is closer to said upper end;

said ends are brought toward each other through said passage;

said passage closes as said ends are moved toward each other.

14. The plug of claim 13, wherein:

said set position allows treating a first zone on one side of said plug while effectively isolating another zone on an opposite side of said plug.

15. A plug for subterranean use between zones where flow between said zones is to be minimized, comprising:

an annularly shaped porous sheath having a fill material therein and defining a passage therethrough, said passage having a first and second end;

said sheath having a run in configuration when said first and second ends are spaced apart from each other and a set position when said first and second ends are moved relatively with respect to said passage;

said ends are brought toward each other through said passage;

one of said ends is attached to a mandrel;

said mandrel degrades with exposure to subterranean conditions or to changed conditions at the subterranean location from a remote location, which results in failure of said sheath to release said material.

16. The plug of claim 15, wherein:

said mandrel is made from a controlled electrolytic material.

17. A plug for subterranean use between zones where flow between said zones is to be minimized, comprising:

an annularly shaped porous sheath having an upper and a lower end when run in and having a fill material therein and defining a passage therethrough, said passage extending between said ends and a mandrel extending in said passage;

said sheath having a run in configuration when said upper and lower ends are spaced apart from each other at a predetermined distance and a set position when said lower end at run in is moved into said passage to define a new lower end for said sheath that is closer to said upper end;

said ends are brought toward each other through said passage;

said material comprises at least one of sand, controlled electrolytic material, rubber chips or coated proppant.

18. A plug for subterranean use between zones where flow between said zones is to be minimized, comprising:

an annularly shaped porous sheath having a fill material therein and defining a passage therethrough, said passage having a first and second end;

said sheath having a run in configuration when said first and second ends are spaced apart from each other and a set position when said first and second ends are moved relatively with respect to said passage;

said ends are brought toward each other through said passage;

one of said ends is attached to a mandrel;

the other of said ends is supported by a stationary backup;

said stationary backup is retained by a setting tool that also relatively moves said mandrel.

19. The plug of claim 18, wherein:

said setting tool moves said mandrel partly through said passage to reconfigure said sheath to said set position before releasing from said mandrel.

20. The plug of claim 18, wherein:

said setting tool moves said mandrel fully through said passage to reconfigure said sheath to said set position before separating said mandrel from said sheath.

21. A plug for subterranean use between zones where flow between said zones is to be minimized, comprising:

an annularly shaped porous sheath having an upper and a lower end when run in and having a fill material therein and defining a passage therethrough, said passage extending between said ends and a mandrel extending in said passage;

said sheath having a run in configuration when said upper and lower ends are spaced apart from each other at a predetermined distance and a set position when said lower end at run in is moved into said passage to define a new lower end for said sheath that is closer to said upper end;

said ends are brought toward each other through said passage;

one of said ends is attached to the mandrel;

the other of said ends is supported by a stationary backup;

relative movement between said mandrel and said backup in a first direction brings said ends toward each other while relative movement in a second direction opposite said first direction is prevented;

a ratchet lock prevents said relative movement in said second direction;

said plug is released with a release tool that engages said mandrel and defeats said ratchet lock by creating relative movement in said second direction.

* * * * *